United States Patent [19]

Wojciechowski

[11] Patent Number: 4,684,287

[45] Date of Patent: Aug. 4, 1987

[54] RETAINING WALL CONSTRUCTION AND METHOD FOR ERECTION

[75] Inventor: Longine J. Wojciechowski, Potomac, Md.

[73] Assignee: The Reinforced Earth Company, Arlington, Va.

[21] Appl. No.: 783,211

[22] Filed: Oct. 2, 1985

[51] Int. Cl.[4] ..... E01F 15/00

[52] U.S. Cl. ..... 404/6; 52/122.1; 52/126.3; 405/286

[58] Field of Search ..... 52/122.1, 126.3, 593, 52/747; 405/286, 287; 404/6, 7, 8

[56] References Cited

U.S. PATENT DOCUMENTS

| | | | |
|---|---|---|---|
| 425,913 | 4/1890 | Smith | 52/593 |
| 427,648 | 5/1890 | Webb | 52/593 |
| 2,420,228 | 5/1947 | Condon | 405/286 |
| 2,695,159 | 11/1954 | Bridwell | 52/593 |
| 3,129,481 | 4/1964 | Sullivan | 249/137 |
| 3,195,312 | 7/1965 | Rumsey | 405/287 |
| 3,225,548 | 12/1965 | Hayden | 405/286 |
| 3,991,528 | 11/1976 | Dillion | 52/259 |
| 4,105,353 | 8/1978 | Bork | 404/6 |
| 4,113,400 | 9/1978 | Smith | 404/6 |
| 4,372,091 | 2/1983 | Brown | 52/604 |
| 4,407,611 | 10/1983 | Murray | 405/284 |
| 4,440,527 | 4/1984 | Vidal | 405/284 |
| 4,463,934 | 8/1984 | Ochoa | 404/6 |
| 4,494,892 | 1/1985 | Wojcechowski | 405/286 |
| 4,557,634 | 12/1985 | Vidal | 405/286 |

FOREIGN PATENT DOCUMENTS

| | | | |
|---|---|---|---|
| 488083 | 11/1952 | Canada | 404/7 |

*Primary Examiner*—John E. Murtagh

*Attorney, Agent, or Firm*—Allegretti, Newitt, Witcoff & McAndrews, Ltd.

[57] ABSTRACT

An improved retaining wall construction includes a plurality of prefabricated, substantially upstanding soil retention panels connected together to define a wall facing. Each soil retention panel has a bottom surface with at least one cutout portion for receiving a lifting arm to lift and transport the soil retention panel, a first end having a projecting portion and a second end having a cutout slot. The projecting portion of one soil retention panel engages the cutout slot of anothe adjacent soil retention panel to form a keyed construction joint.

Earth is exacavated along a line demarking the wall construciton, and a concrete leveling pad is placed along the line. The soil retention panel is positioned on the leveling pad by means of an apparatus for lifting having lifting arms that are slidably engageable into the cutout portion of the soil retention panel. The lifting apparatus includes means for attaching the lifting apparatus to a lifting crane and means for holding the soil retention panel on the lifting arms until the soil retention panel is positioned and anchored.

8 Claims, 9 Drawing Figures

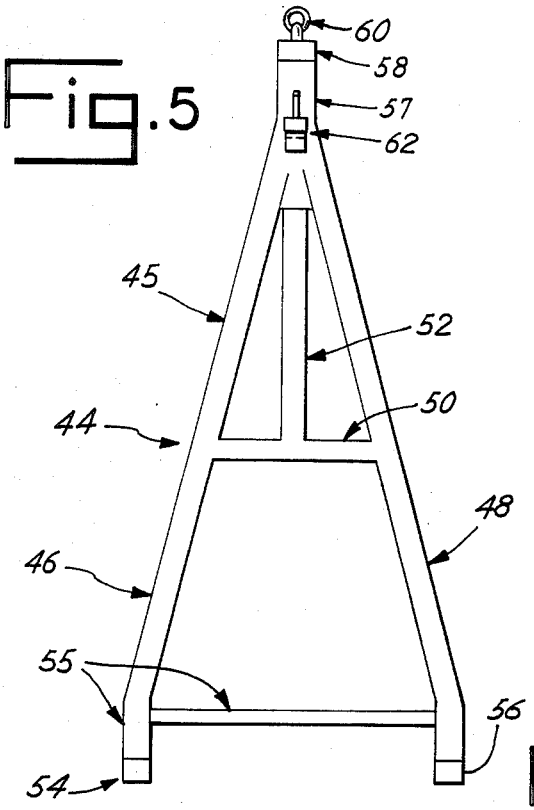
Fig. 5
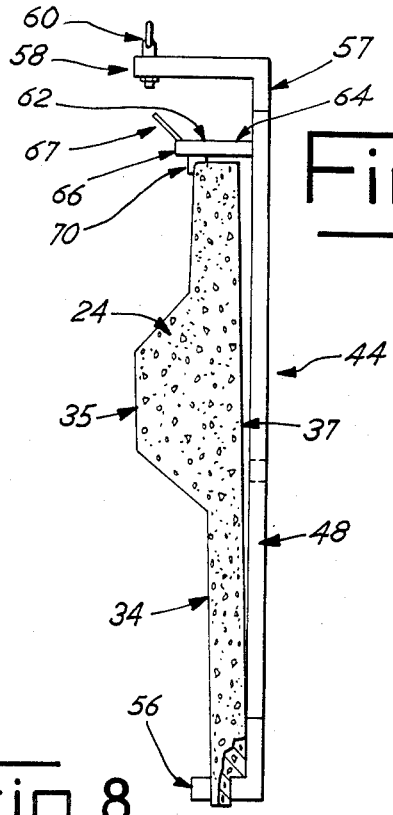
Fig. 6
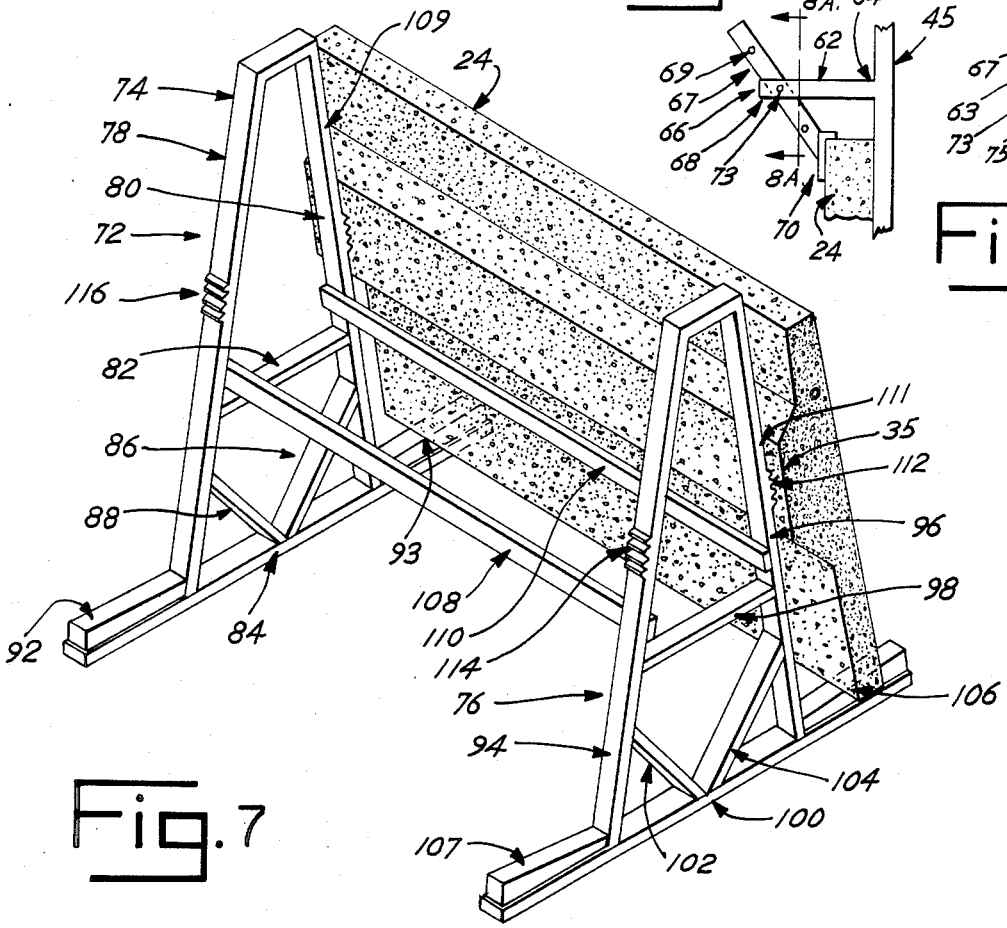
Fig. 7
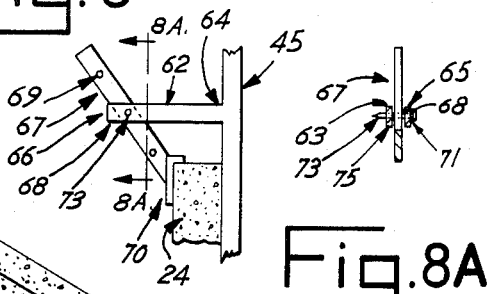
Fig. 8
Fig. 8A

RETAINING WALL CONSTRUCTION AND METHOD FOR ERECTION

BACKGROUND OF THE INVENTION

The invention relates to an improved retaining wall and more particularly to a low-height retaining wall system.

Retaining walls often constitute a vertical support barrier for an earthen embankment. They may also be made using earth reinforcement techniques wherein a vertical panel defines a facing for a retaining embankment. Retaining walls vary in size and construction depending on the type of wall. A typical application for a retaining wall involves bi-level, separated roadways in which the elevation of one roadway varies from the elevation of an adjacent roadway. A low-height retaining wall is often positioned between the two roadways to retain soil and other materials of the elevated side. A cross section of such a bi-level roadway system is shown in FIG. 2.

A typical low-height retaining wall for a bi-level roadway system may be made of reinforced concrete cast in place. For a cast-in-place wall, a large concrete pedestal or footing is cast at the base of the wall having an extension which projects into or underlies the embankment that is to be retained. An integral upstanding, reinforced wall is cast on the footing. Precast traffic rails or barriers (see FIG. 2, element 16) having a side with a profile for redirecting an incident vehicle away from the wall are then placed adjacent each side of the cast-in-place retaining wall at the respective elevation of the respective roadways.

Another type of low-height retaining wall for a bi-level roadway system may be made of precast, reinforced concrete panels as shown on FIGS. 1 and 2. The precast panels are usually manufactured away from the construction site and transported to the construction site for placement on a small leveling pad between the bi-level roadways. Typically, the precast panel incorporates a traffic rail on at least one side with a profile for directing an incident vehicle away from the side. The connections between adjoining precast concrete panels are doweled reinforcing bars. See FIG. 1.

The advantages of a precast concrete panel wall compared to a cast-in-place retaining wall include (1) elimination of the substantial footings; (2) reduction of installation time and cost since on-site forming and pouring of concrete are eliminated; and (3) easy incorporation of a traffic rail into the wall structure. On the other hand, precast, reinforced concrete panels are heavy and bulky causing handling problems during transit or when positioned at the construction site.

Therefore, even though precast, reinforced concrete panels are very useful, there has remained a need and desire to provide an improved precast soil retention panel which may be easily and quickly lifted, transported and installed at a construction site.

SUMMARY OF THE INVENTION

In a principal aspect, the present invention comprises an improved retaining wall construction and method of erection thereof. The retaining wall construction includes a plurality of prefabricated, substantially vertical soil retention panels having a bottom surface with at least one cutout portion or recess for receiving a lifting arm during transporting and installing of the soil retention panel. The soil retention panels generally comprise precast, reinforced concrete panels.

To form the wall construction, adjacent soil retention panels are connected to one another, thereby defining a retention wall facing. The means for connection are keyed construction joints formed in adjacent sides of the soil retention panels. Thus, one side of a panel includes a cutout slot for engaging with a projection from the opposed side of the adjacent panel.

The soil retention panels are transported to a construction site in a substantially upright position on a storage frame mounted on a transport vehicle. To effect construction at the site, earth is first excavated along at least one side of a line demarking the wall construction, and a concrete leveling pad is placed along the line. The soil retention panels are positioned by means of a lifting apparatus on the leveling pad in a contiguous relationship. Each soil retention panel is connected to the previously positioned adjacent soil retention panel and is also attached to means extending into the soil. Finally, any voids between the soil and the soil retention panel are filled.

An important feature of the invention relates to the lifting apparatus for lifting and positioning the soil retention panels. The lifting apparatus has a substantially upright lifting frame with top and bottom sections. At least one lifting arm is connected to the bottom section and may be slidably inserted into the cutout portion of the soil retention panel to support the panel when it is lifted. The lifting apparatus also includes means for attaching the top section of the lifting frame to a lifting crane and means for holding the soil retention panel on the lifting arm until the soil retention panel is positioned and anchored.

Another important feature of the invention is the storage frame for holding the soil retention panel in a substantially upright position during transport. The storage frame has opposite ends connected by at least one substantially horizontal member. The ends define a rigid, upright framework. The sides of the framework are used as bearing surfaces for maintaining a soil retention panel in a substantially upright position when the soil retention panel rests against the storage frame.

Thus, it is an object of the invention to provide an improved retaining wall construction comprised of a plurality of prefabricated soil retention panels which can be lifted and positioned easily and quickly.

Another object of the invention is to provide an improved method of construction for a retaining wall comprised of prefabricated soil retention panels.

Yet another object is to provide an improved means for lifting a soil retention panel by crane and for transporting soil retention panels in a substantially upright position.

Another object of the invention is to provide an improved retaining wall construction comprised of soil retention panels wherein the soil retention panels can be easily and quickly connected together to define a wall facing.

These and other objects, advantages and features of the invention will be set forth in the detailed description which follows.

BRIEF DESCRIPTION OF THE DRAWING

In the detailed description that follows, reference will be made to the drawing comprised of the following figures:

FIG. 5 is a front view of the apparatus for lifting a soil retention panel;

FIG. 6 is a side elevation view of the apparatus for lifting a soil retention panel showing the soil retention panel held in place in a substantially upright position;

FIG. 7 is a perspective view of the storage frame for mounting a soil retention panel on a transport vehicle showing the soil retention panel maintained in a substantially upright position; and FIG. 8 depicts the details of the means for holding a soil retention panel on the lifting arms of an apparatus for lifting.

FIG. 8A is a cross-sectional view of FIG. 8.

DESCRIPTION OF THE PREFERRED EMBODIMENT

Figure 1:
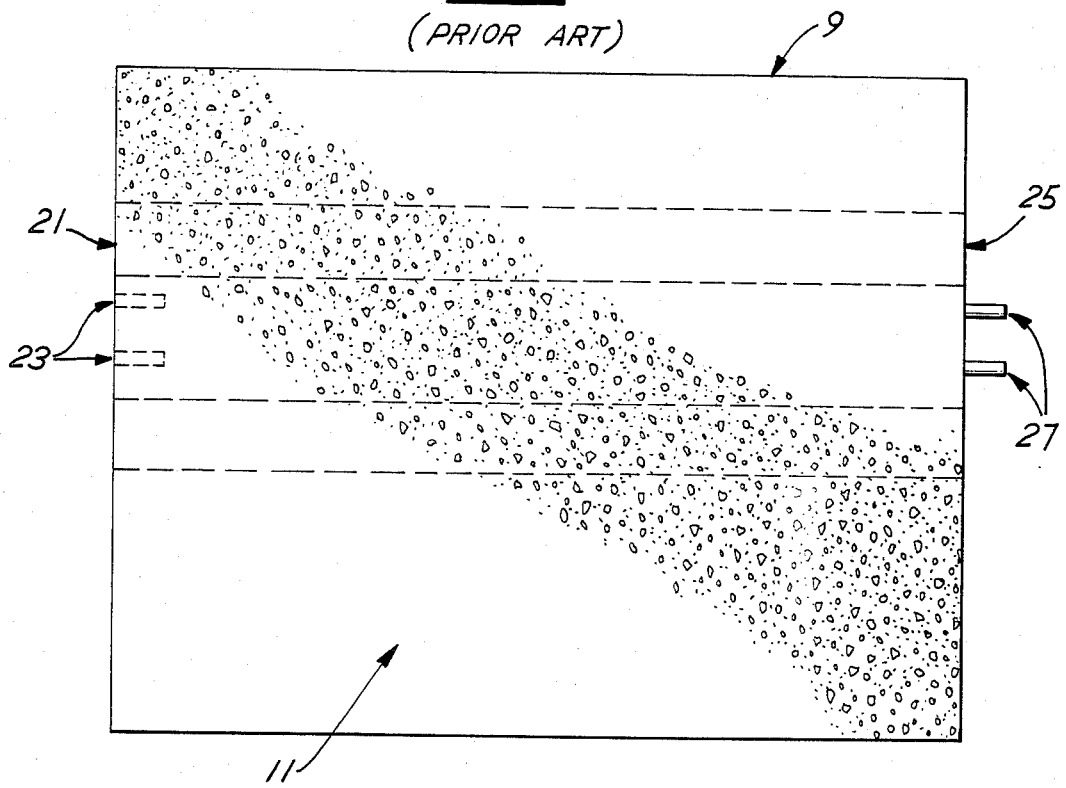
Fig. 1 (PRIOR ART)
FIG. 1 is a front elevation view of the front face in a prior art, precast concrete panel.
Figure 2:
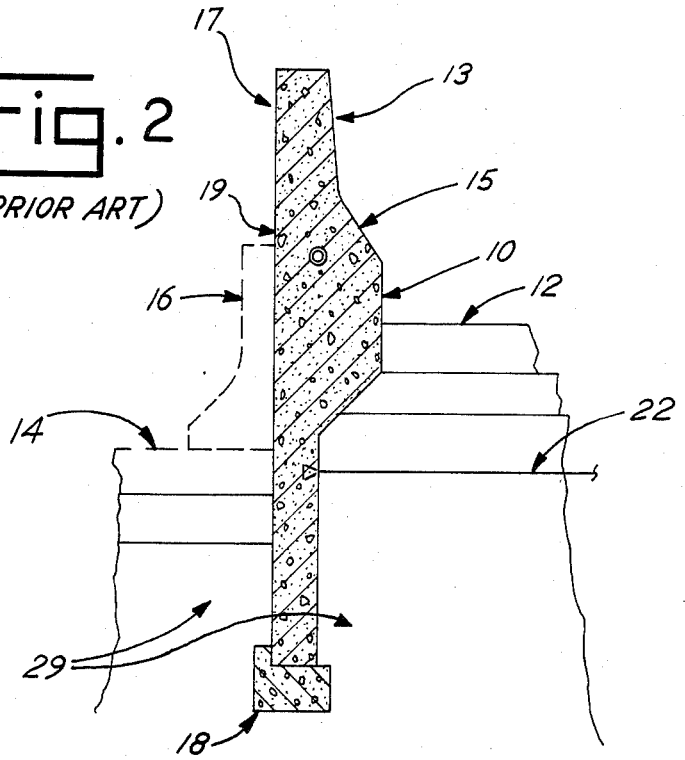
Fig. 2 (PRIOR ART)
FIG. 2 is a side cross-sectional view of a prior art, precast concrete panel utilized as a low-height retaining wall between bi-level roadways.

FIGS. 1 and 2 illustrate a known prior art precast concrete panel 9 used in the construction of a low-height retaining wall for retaining soil between bi-level roadways. The precast concrete panel 9 is constructed of precast, reinforced concrete and generally defines a rectangular front facing 11. The precast concrete panel 9 typically is heavy, bulky and difficult to transport, lift, and position during erection at the construction site.

Referring to FIG. 2, the precast concrete panel 9 has a distinct cross-sectional shape uniquely adapted for placement between adjacent roadways 12, 14 located at different elevations. Side 13 of the precast concrete panel 9 includes a projecting section 10 having a profile 15 for directing an incident vehicle away from the side 13. Projecting section 10 is positioned with respect to roadway 12 so that side 13 can be used as a traffic rail in accordance with state highway requirements. The shape of the profile 15 of projecting section 10 is based on state highway rules and regulations. The profile 15 may be different for different states.

Side 17 of the precast concrete panel 9 forms a planar, substantially vertical facing 19. The surface elevation of roadway 14 may be located anywhere along the vertical facing 19 of side 17 as construction conditions dictate. A traffic rail 16 is placed adjacent to side 17 to meet state highway requirements.

A plurality of precast concrete panels 9 are connected together to define a low-height retaining wall for retaining soil. Each precast concrete panel 9 has a first end 21 having counter bore passages 23 cored therein and a second end 25 having projecting reinforcing bars 27 partially embedded in the precast concrete panel 9. The reinforcing bars 27 of a precast concrete panel 9 engage or fit into the passages 23 of the adjacent precast, concrete panel 9 to form a doweled joint.

Generally, the construction sequence for installing the prior art, precast concrete panels 9 includes: (1) excavating the soil 29 along the sides of a line demarking the wall construction; (2) installing a concrete leveling pad 18 along the line demarking the wall construction; (3) prefabricating the precast concrete panel 9 and transporting the same to the construction site; (4) positioning the precast concrete panels 9 on the leveling pad 18 in a contiguous relationship; (5) connecting the precast concrete panels 9 to means attached to a supporting structure or extending into the soil 29; and (6) backfilling the excavated area to grade level.

Typically, the precast concrete panels 9 have been lifted by cranes with ropes, cables, chains or similar devices strapped completely around the panel 9. This represented a cumbersome, time-consuming method for lifting and transporting the precast concrete panels 9. Furthermore, the prior art concrete panels 9 could not be aligned into final position or connected until the lifting ropes and devices were removed from the underside or ends of the panels 9. Thus, the precast concrete panels 9 had to be maneuvered into final position by other means. Overall, it was a difficult process to move the precast concrete panels 9.

Figure 3:
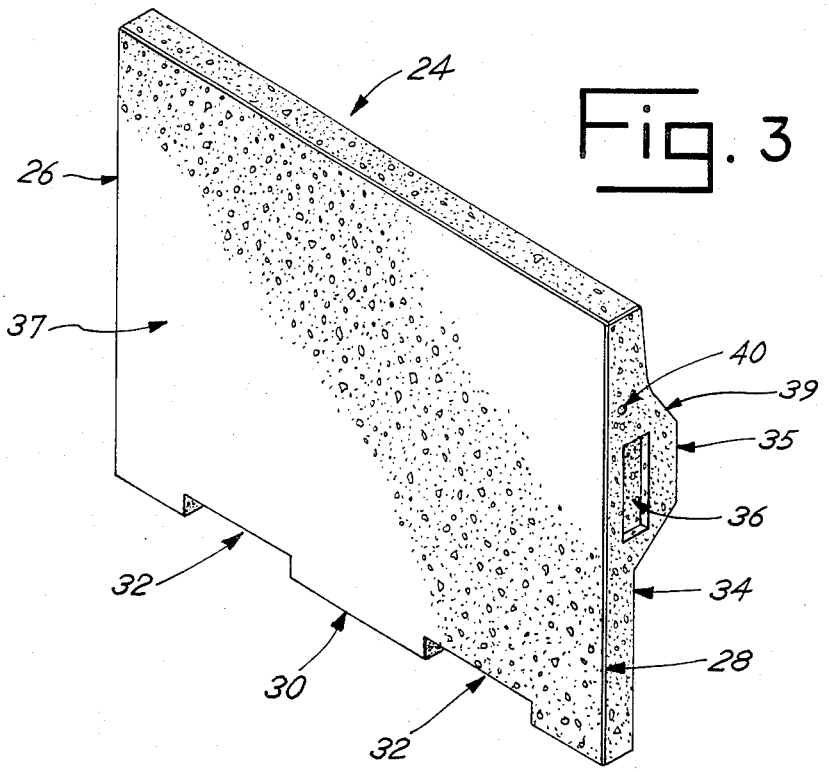
FIG. 3 is a perspective view of the new soil retention panel utilized in the manufacture of the improved retaining wall construction of the invention.
Figure 4:
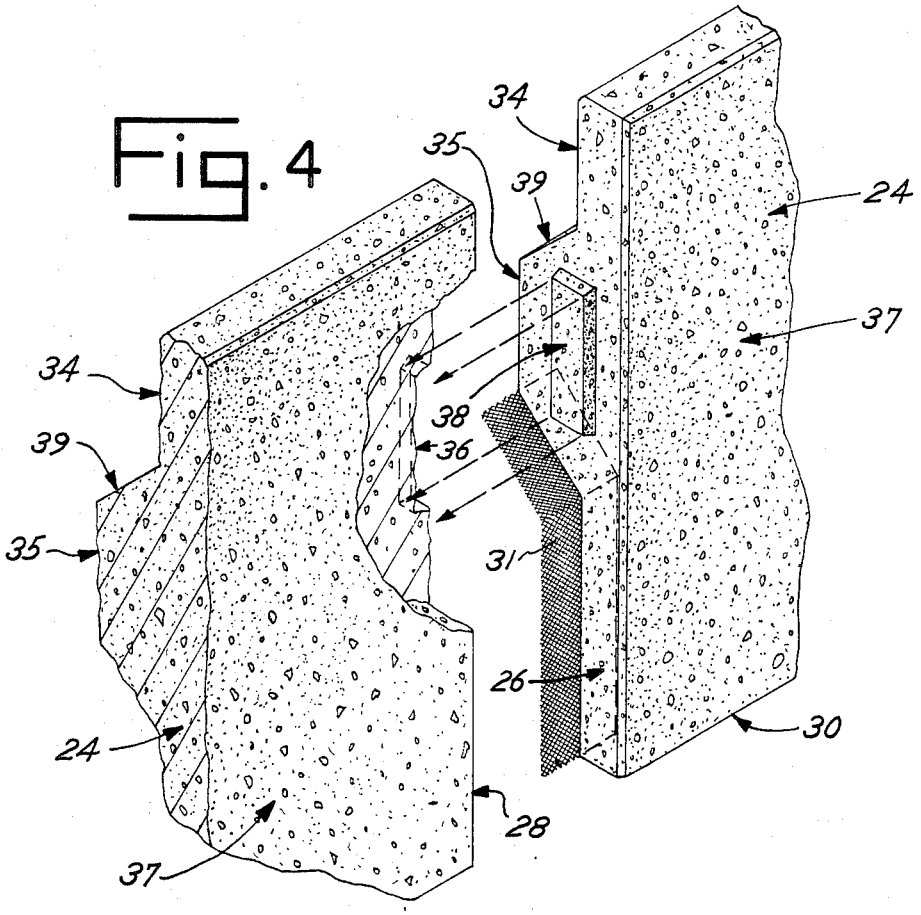
FIG. 4 is a perspective view of the new soil retention panels showing means for connecting the soil retention panels together to define an improved retaining wall construction.

FIGS. 3 through 5, by contrast, represent the improved retaining wall construction and apparatus used for erection thereof to solve the handling problems of the prior art constructions and methods. The improved retaining wall construction comprises a plurality of prefabricated, substantially upstanding soil retention panels 24 depicted in FIGS. 3 and 4. Each soil retention panel 24 is a precast, reinforced concrete panel 24 fabricated by methods and techniques well known to one of ordinary skill in the art. Forms are made or erected to establish a shape or mold for the soil retention panel 24. Using standard and known engineering techniques, a reinforcing grid of reinforcing steel bar is inserted into the form. Concrete is then poured into the form so that the soil retention panel 24 will be defined within the form.

In the preferred embodiment depicted in FIGS. 3, 4 and 6, the soil retention panel 24 has a first end 26 having a key or projecting portion 38, a second end 28 including a recess or cutout slot 36 and a bottom surface 30 with notches or cutout portions 32, 33 for receiving lifting arms 54, 56 during transportion and installation of the soil retention panel 24. Cutout portions 32, 33 are spaced apart to correspond with the spacing of lifting arms 54, 56. The depth of cutout portions 32, 33 is slightly greater than the height of lifting arms 54, 56. Side 34 of the soil retention panel 24 includes a projecting rib or section 35 having a profile 39 for directing an incident vehicle away from the side 34. The shape of the profile 39 formed by side 34 and projecting section 35 is dictated by the state highway rules and regulations for traffic rails.

The face 37 on the opposite side of the soil retention panel 24 is substantially planar. A polyvinyl chloride or other material conduit 40 may be embedded within the soil retention panel 24 extending from the first end 26 to the second end 28 to provide a raceway throughout the width of the panel 24.

Referring to FIG. 4, soil retention panels 24 are connected together through a keyed construction joint which is formed by the key or projecting portion 38 of a soil retention panel 24 engaging with the recess or cutout slot 36 of another adjacent soil retention panel 24 positioned in a contiguous relationship. A plurality of soil retention panels 24 connected together define a retention wall facing. A netting or filter cloth 31, such as Mirafi 140N, is affixed with adhesive compound over the keyed construction joints on side 34 for retaining soil at the joints.

The soil retention panel 24 may be retained in position by any acceptable anchoring means. FOr example, anchor rods or tie wires attached to the soil retention panel 24 may be extended into the soil and secured to an anchor block or supporting structure.

Also, as shown in FIG. 2, an earth reinforcing means comprised of reinforcing strips 22 attached to the soil retention panel 24 and projecting into the soil 29 in a direction substantially transverse to the plane of the retention wall facing may be used. Such earth reinforcement techniques and methods are disclosed in Vidal, U.S. Pat. No. 3,421,326 entitled "Constructional Works" and Vidal, U.S. Pat. No. 3,686,873 entitled "Constructional Works".

The soil retention panel 24 can be easilty and quickly lifted, transported and maneuvered in a substantially upstanding position when used in conjunction with the new apparatus for lifting 44 depicted in FIGS. 5 and 6. The apparatus for lifting 44 comprises a generally triangular shaped lifting frame 45. Frame 45 has the shape of an isosceles triangle formed by equal length side members 46, 48, and a bottom section or connecting base member 55. The lifting frame 45 is reinforced by a horizontal reinforcing member 50 and a vertical reinforcing member 52 extending from member 50 to the apex of the frame 45. Lifting arms 54 and 56 project transversely from base member 55. A top section or bracket 57 extends from the apex and an outwardly extending arm 58 extends transversely from the lifting frame 45. A support link or ring 60 is attached to arm 58 for cooperation with a lifting crane hook. The arm 58 extends from lifting frame 45 in the same direction as arms 54, 56.

Referring to in FIG. 8, the second end 66 of the outwardly extending arm 62 has a slot defined by opposed flanges 63, 65. A slidable intermediate holding member 67 is received in the slot. Intermediate holding member 67 has a plurality of openings 69 spaced along the length of the intermediate holding member 67. One of the openings 69 may be aligned with opening 71, 75 through flanges 63, 65 to permit fastening of the intermediate holding member 67 to the opposed flanges 63, 65 with a detachable pin 73. A clamp 70 is attached to one end of the intermediate holding member 67 and may be positioned and held by pin 73 for maintaining the soil retention panel 24 in position on the lifting frame 45. A bar 68 connecting the opposed flanges 63, 65 at the second end 66 engages the intermediate holding member 67 to prevent the member 67 from pivoting about pin 73 away from the lifting frame 45.

The advantages of using the soil retention panel 24 in cooperation with the apparatus for lifting 44 are evident from FIG. 6. The apparatus for lifting 44 holds the soil retention panel 24 in an upstanding position without any members, elements or ropes wrapping around the bottom surface 30, the ends 26, 28 or the side 34 of the soil retention panel. Thus, the apparatus for lifting 44 can be used to support and maneuver the soil retention panel 24 into proper alignment and allow the panel 24 to be anchored before the grasp of the apparatus for lifting 44 is removed. This results since the lifting arms 54, 56 slidably engage or disengage from notches or cutout portions 32, 33 even in the event the soil retention panel 24 is supported on a surface by the bottom surface 30 of panel 24. Also, final construction can be undertaken along side 34 of the soil retention panel 24 without any interference from the apparatus for lifting 44. The improved retaining wall construction can be installed more quickly than the prior art constructions. The apparatus for lifting 44 also enables the contractor to better control the bulky, heavy soil retention panel so that damage to the panel is reduced during construction.

Referring now to FIG. 7, another important feature of the present invention is the storage frame 72 for mounting the soil retention panel 24 in a substantially upright position on a transport vehicle during transfer of the soil retention panel 24 from the fabricating site to the construction site. The storage frame 72 permits the lifting arms 54, 56 of the lifting frame 45 to slidably engage the recess or cutout portions 32, 33 of the soil retention panel 24 stored on a transport vehicle.

The storage frame 72 has upstanding opposite ends 74 and 76 connected by substantially horizontal members 108 and 110. One opposite end 74 is comprised of an assemblage of members 78, 80, 82, 84, 86 and 88 to define a rigid, upright, A-shaped framework with a face substantially transverse to the direction of the horizontal members 108 and 110. The other opposite end 76 is comprised of an assemblage of members 94, 96, 98, 100, 102 and 104 to define a rigid, upright, A-shaped framework with a face substantially transverse to the direction of the horizontal members 108 and 110.

The sides 109 and 111 of the framework at opposite ends 74 and 76, respectively, are used as bearing surfaces for maintaining the soil retention panel 24 in a substantially upright position when the projecting section 35 of the soil retention panel 24 rests against the sides 109, 111. One soil retention panel 24 can be mounted on each side of the storage frame 72. Bearing plates 112, 114, 116 and 118 made of plastic or similar material are mounted on the sides of the framework at opposite ends 74 and 76 for receiving the soil retention panel 24.

In the preferred embodiment, the storage frame 72 includes projecting platforms 92, 93, 106 and 107 secured to the bottom of each framework, respectively, as depicted in FIG. 7. The projecting platforms 92, 93, 106 and 107 are substantially normal to the face of the storage frame 72 for carrying the soil retention panel 24.

The interaction of the improved soil retention panels 24, the apparatus for lifting 44 and the storage frame 72 can best be appreciated by understanding the method for erection of an improved wall construction at a construction site. The soil retention panels 24 are prefabricated at a manufacturing site and transported to the construction site on a transport vehicle having mounted thereon the storage frame 72 for holding the soil retention panel 24 in a substantially upright position.

At the construction site, soil and other debris are excavated along a line demarking the wall construction, and a concrete leveling pad 18 is installed along that line. The apparatus for lifting 44 is used to lift and position the soil retention panels 24 in a contiguous relationship along the line demarking the wall construction. The lifting apparatus 44 need not be removed from holding the soil retention panel 24 until the panel 24 is properly aligned and connected because of the cooperative relationship of lifting arms 54, 56 with cutout portions 32, 33 previously described. The procedure continues as each subsequent panel 24 installed. A netting or filter cloth (31) is affixed over the joint between adjacent soil retention panels.

The soil retention panel 24 may be retained in position by anchor rods or tie wires attached to the soil retention panel 24 and secured to an anchor block or supporting structure. Alternatively, earth reinforcing means using reinforcing strips 22 attached to the soil retention panel 24 and projecting into the soil 29 may be used. Finally, the voids intermediate the soil surface formed by the excavation and the soil retention panels are filled to bring the soil to the desired grade level.

The preferred embodiment of the invention is set forth above. It is to be understood that there may be alternative shapes, sizes and number for these notches or cutout portions 32, 33 of the soil retention panel 24 and for the lifting arms 54, 56 of the apparatus for lifting 44. The lifting frame 45 of the apparatus for lifting 44 and the opposite ends 74, 76 of the storage frame 72 may utilize framework other than A-shaped framework, i.e., H-shaped. Also, it is to be understood that the invention is to be limited only by the following claims and their equivalents.

What is claimed is:

1. An improved retaining wall construction for retaining soil, said wall construction comprising in combination:

a plurality of prefabricated, substantially upstanding soil retention panels, each soil retention panel having first and second ends, a bottom surface with at least one cutout portion in the bottom surface for receiving a lifting arm during transportation and installing of the soil retention panel, and a side, the side including a projecting rib having a profile for directing an incident vehicle away from the side;

the first and second ends of each soil retention panel having a top section, a center section incorporating the projecting rib with the vertical length of the projecting rib defining the extent of the center section, and a bottom section;

a keyed construction joint comprised of the first end of the soil retention panel having a projecting portion and the second end of the soil retention panel having a cutout slot for engaging with the projecting portion of an adjacent soil retention panel, the cutout slot encapsulating the projecting portion of an adjacent soil retention panel in a contacting relationship for preventing movement of the soil retention panels in vertical and horizontal directions for defining a retention wall having a generally planar face, the keyed construction joint positioned entirely within the center section of the first and second ends of the soil retention panels for distributing impact forces uniformly; and means attached to one side of the soil retention panel and extending into the soil for supporting the soil retention panel in an upright position.

2. The wall construction of claim 1 wherein the soil retention panels comprise precast, reinforced concrete panels.

3. The wall construction of claim 1 wherein the projecting portion and cutout slot of the keyed construction joint both have a substantially rectangular shape.

4. The wall construction of claim 3 wherein netting is affixed over the keyed construction joint for retaining soil.

5. The wall construction of claim 4 wherein the netting is a filter cloth.

6. The wall construction of claim 1 wherein the bottom surface of each soil retention panel has two cutout portions transverse to the plane of the retention wall facing.

7. The wall construction of claim 1 said means attached to one side of the soil retention panel comprising an earth reinforcing means, said reinforcing means projecting into the soil in a direction substantially transverse to the plane of the retention wall facing and connected to the facing.

8. The wall construction of claim 1 in combination with a concrete leveling pad, the bottom surface of the soil retention panel positioned on the concrete leveling pad, the bottom surface of the soil retention panel positioned on the concrete leveling pad.

* * * * *